US006591627B1

(12) United States Patent
Rollins

(10) Patent No.: US 6,591,627 B1
(45) Date of Patent: Jul. 15, 2003

(54) FLUSH MOUNT WET LOOP FOR USE WITH CONDENSER COILS

(75) Inventor: DeWitt D. Rollins, LaVergne, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/153,374

(22) Filed: May 22, 2002

(51) Int. Cl.[7] ..... F25D 21/14
(52) U.S. Cl. ..... 62/285; 62/277; 165/173
(58) Field of Search ..... 62/285, 277, 279, 62/305, 515; 165/173, 158, 153

(56) References Cited

U.S. PATENT DOCUMENTS 3,827,485 A * 8/1974 Hickman et al. ..... 165/171
5,348,081 A * 9/1994 Halstead et al. ..... 165/144
5,966,958 A * 10/1999 Maynard ..... 62/277

* cited by examiner

*Primary Examiner*—Melvin Jones
(74) *Attorney, Agent, or Firm*—Robert O. Rice; John F. Colligan; Thomas J. Roth

(57) ABSTRACT

A refrigeration device is provided having a compressor, a condenser, an evaporator, and tubing to connect the compressor to the condenser, the condenser to the evaporator and the evaporator to the compressor. The condenser coil includes a plurality of tubes arranged in horizontal and vertical rows extending between vertically arranged header plates with return bends interconnecting the tubes to form a serpentine shaped circuit. The header plates are provided with at least one notch in a bottom edge thereof to accommodate a tube extending therebetween. In an embodiment, a wet loop is positioned in the area of the notches in the header plates.

16 Claims, 9 Drawing Sheets

FLUSH MOUNT WET LOOP FOR USE WITH CONDENSER COILS

BACKGROUND OF THE INVENTION

The present invention relates to refrigeration devices, such as room air conditioners, and more particularly, to refrigeration devices having condenser coils from which heat is to dissipated.

Refrigeration devices, such as room air conditioners, utilize a condenser coil to dissipate heat from a refrigerant. Such refrigeration devices also typically include an evaporator coil over which warm moist air is directed to cool the air with the further results that moisture is condensed from that air and this condensate is collected below the evaporator. Oftentimes this liquid is directed back to the area where the condenser coil is located. It is known to use this condensate water for cooling, or sub-cooling, the refrigerant flowing through the condenser coil and it is also known to submerge a coil in this water, such as disclosed in U.S. Pat. No. 3,996,764.

Typically the lower portion of the refrigeration apparatus, such as a metal chassis plate, is specially configured to include an embossment or other recessed area for receiving the submerged condenser coil. In some arrangements, the sub-cooling tube or wet loop has a particular configuration which is designed to fit in a specially configured space in the air conditioner base pan. In other arrangements, the use of a sub-cooling tube or wet loop requires the use of additional parts and labor to assemble the submerged coil.

SUMMARY OF THE INVENTION

The present invention provides for a wet loop or sub-cooler tube to be used under a full-length condenser coil and to allow the wet loop to fit flush with the bottom of the condenser coil without a sump or emboss below the condenser coil. A condenser unit embodying the principles of the present invention allows a condenser coil to be made, that does not require a wet loop, without additional tooling changes or use of additional parts. Further, the condenser coil according to the present invention maximizes the amount of primary and secondary surfaces that are located in the condensate water while minimizing the required space.

In an embodiment, a header plate, located on both ends of the condenser coil, has two symmetrical notches that are placed at the bottom of the condenser coil. These notches are aligned with the tubing of the condenser so that tubes in the bottom row of the condenser coil are received through the fins between the notches and each notch is positioned directly below a tube in the next adjacent row above the notch. If a wet loop tube is required an appropriate distributor is brazed in place for a particular air conditioner configuration, the fin stock of the condenser coil is pushed to flatten the individual fins down in alignment with the groove. The wet loop is then inserted into this groove of the condenser coil and braised in place. An appropriate distributor is then added to complete the assembly. If a wet loop is not required, the coil is inserted into the unit without pushing the fin stock over and no other tooling changes are needed and no additional parts are used to complete the coolant circuit.

DETAILED DESCRIPTION OF THE PREFERRED EMBODIMENT

The present invention relates to a refrigeration device, such as a room air conditioner which typically is positioned in a window or in a through the wall sleeve such that a front part of the air conditioner unit is positioned in a space to be cooled and a back part is exposed to the exterior of the space. While the present invention can be utilized in many different types of refrigeration devices, it is shown and described in one particular room air conditioner unit, for illustrative purposes, however the scope of the claims should not be limited to the embodiment illustrated and described.

Figure 1:
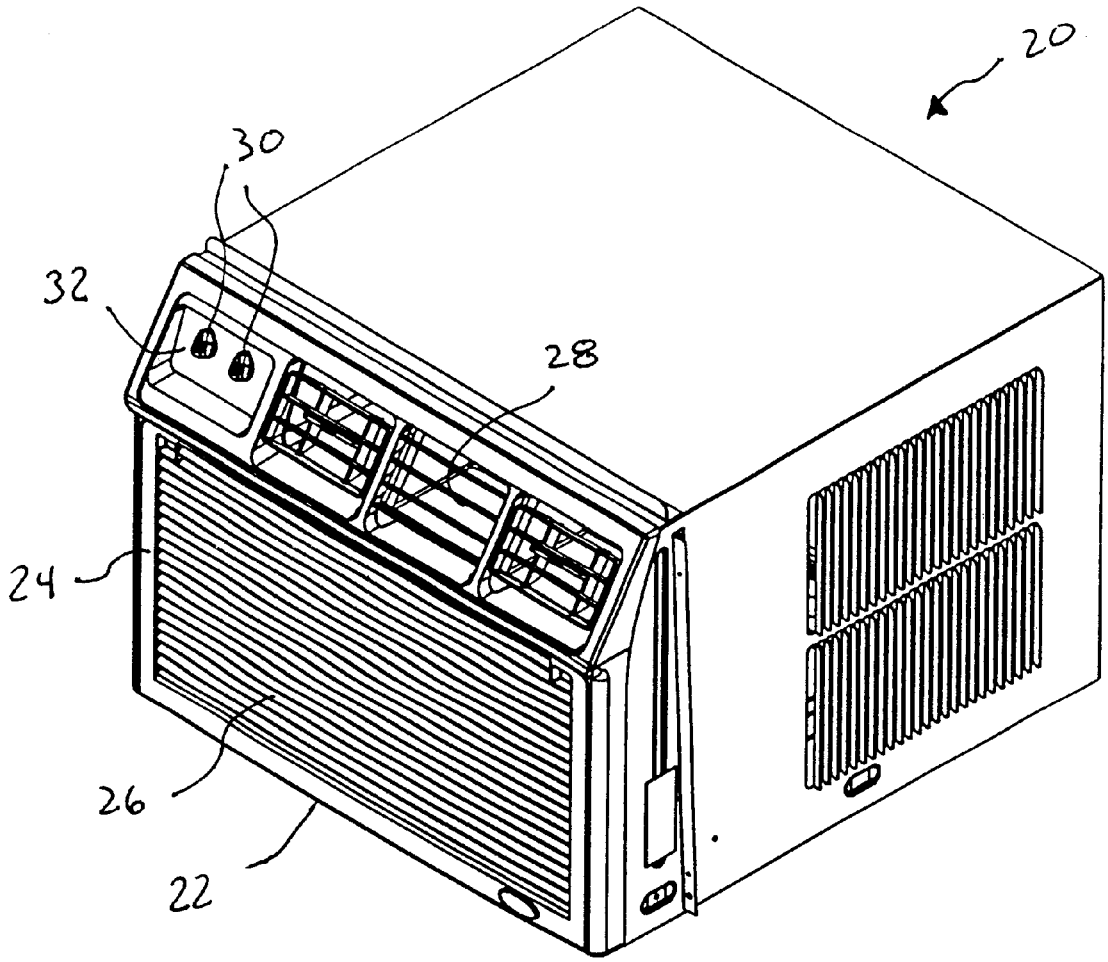
FIG. 1 is a perspective view of a room air conditioner in which the present invention can be utilized.

In FIG. 1 there is illustrated a room air conditioner 20 embodying the principles of the present invention which comprises a cabinet portion 22 facing the interior of a space to be cooled, including a front panel 24 with an air flow inlet grill 26 and an air flow outlet grill 28. A plurality of controls 30 are arranged on a control panel 32 located on the front panel 24. Room air is pulled into the air flow inlet grill 26 and discharged back into the room through the air flow outlet grill 28.

Figure 2:
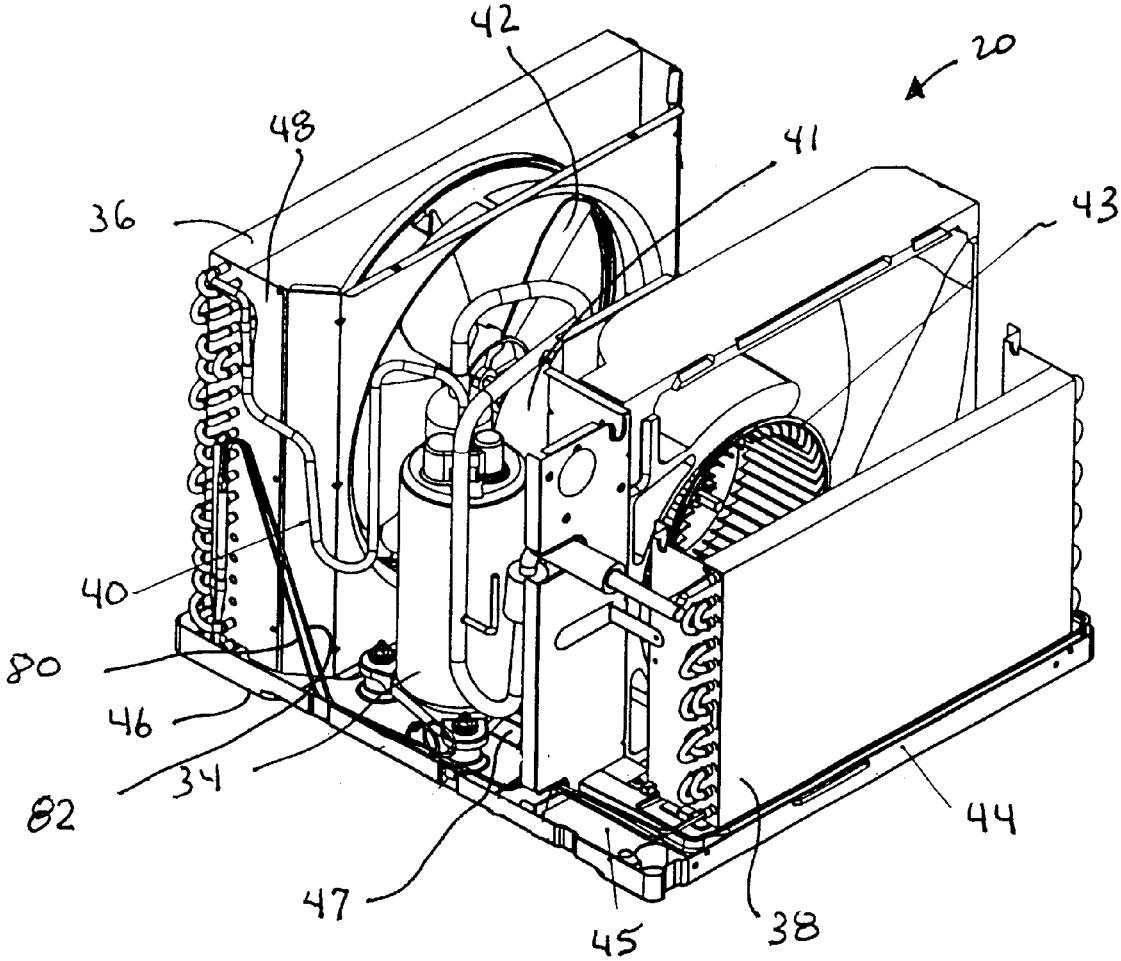
FIG. 2 is a perspective view of the room air conditioner of FIG. 1, with the outer shroud removed to expose interior components.
Figure 3:
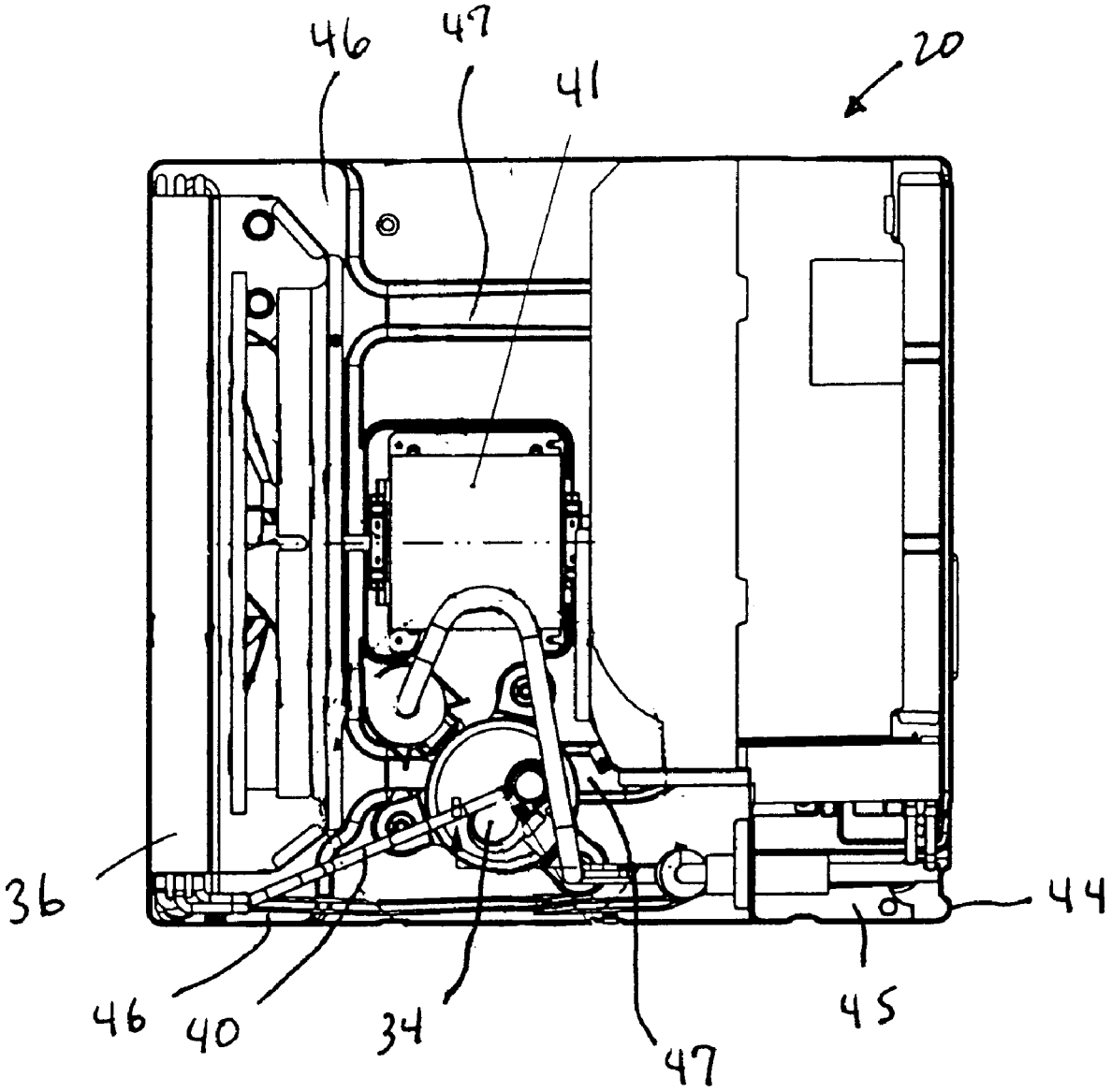
FIG. 3 is a plan view of the interior of the room air conditioner of FIG. 1.

In FIGS. 2 and 3, some of the interior components of the room air conditioner 20 are illustrated including a compressor 34, a condenser coil 36 and an evaporator coil 38, all interconnected by refrigeration tubing 40 as is known in the art. A single motor 41 is used to drive a condenser fan 42 and an evaporator blower wheel 43, also as is known. The air conditioner 20 includes a base pan or chassis 44 to support the evaporator coil 38, the condenser coil 36 and the compressor 34, as well as the other internal components. The base plate pan includes a collecting area 45 positioned below the evaporator coil 38 to collect condensate which collects on the evaporator coil during operation of the air conditioner and drips onto the base pan. The base pan 44 also includes a depression 46 that the condenser coil 36 sits in which accommodates and entire width and depth of the condenser coil therein. A flow path 47 extends between the collecting area 45 and the sump 46 to permit condensate from the collecting area 45 to be received in the depression. Although the flow path is illustrated as two channels formed in the base pan 44, other arrangements could be provided, including a single channel, or more than two channels or conduits and a pump extending between the collecting area 45 and the depression 46.

Figure 4:
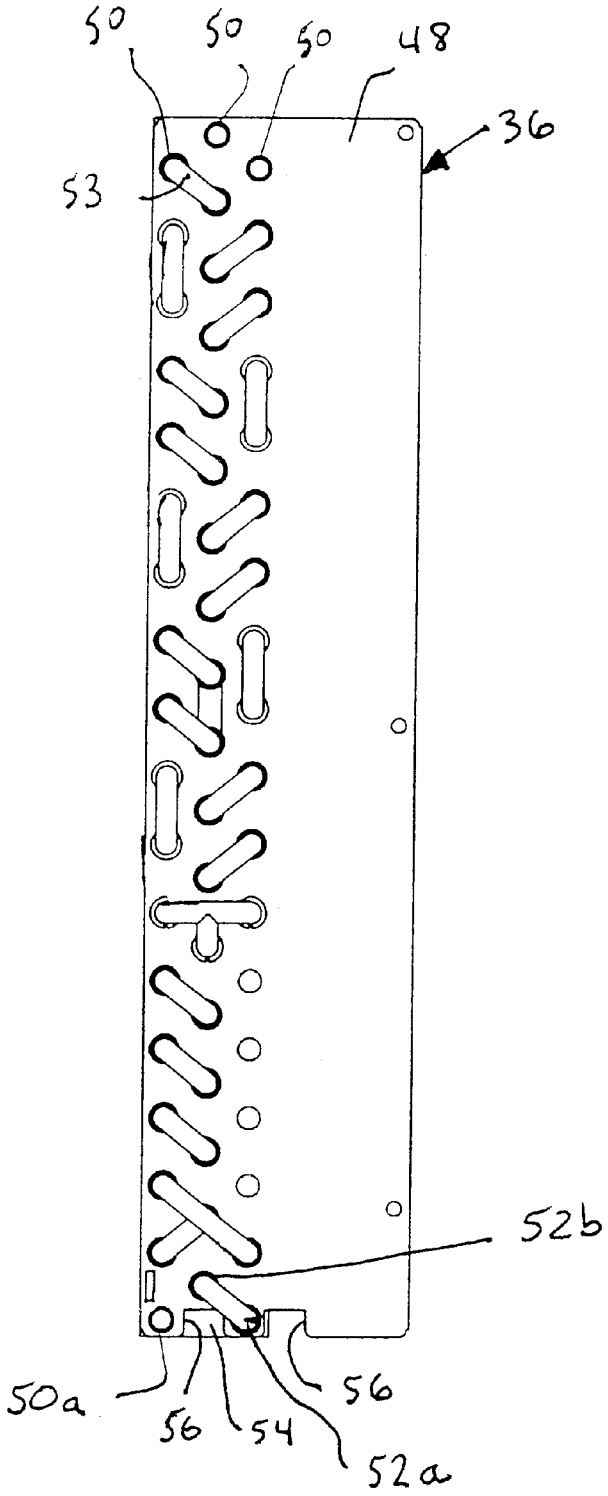
FIG. 4 is a side elevational view of a condenser header plate embodying the principles of the present invention and refrigerant tubing.
Figure 5:
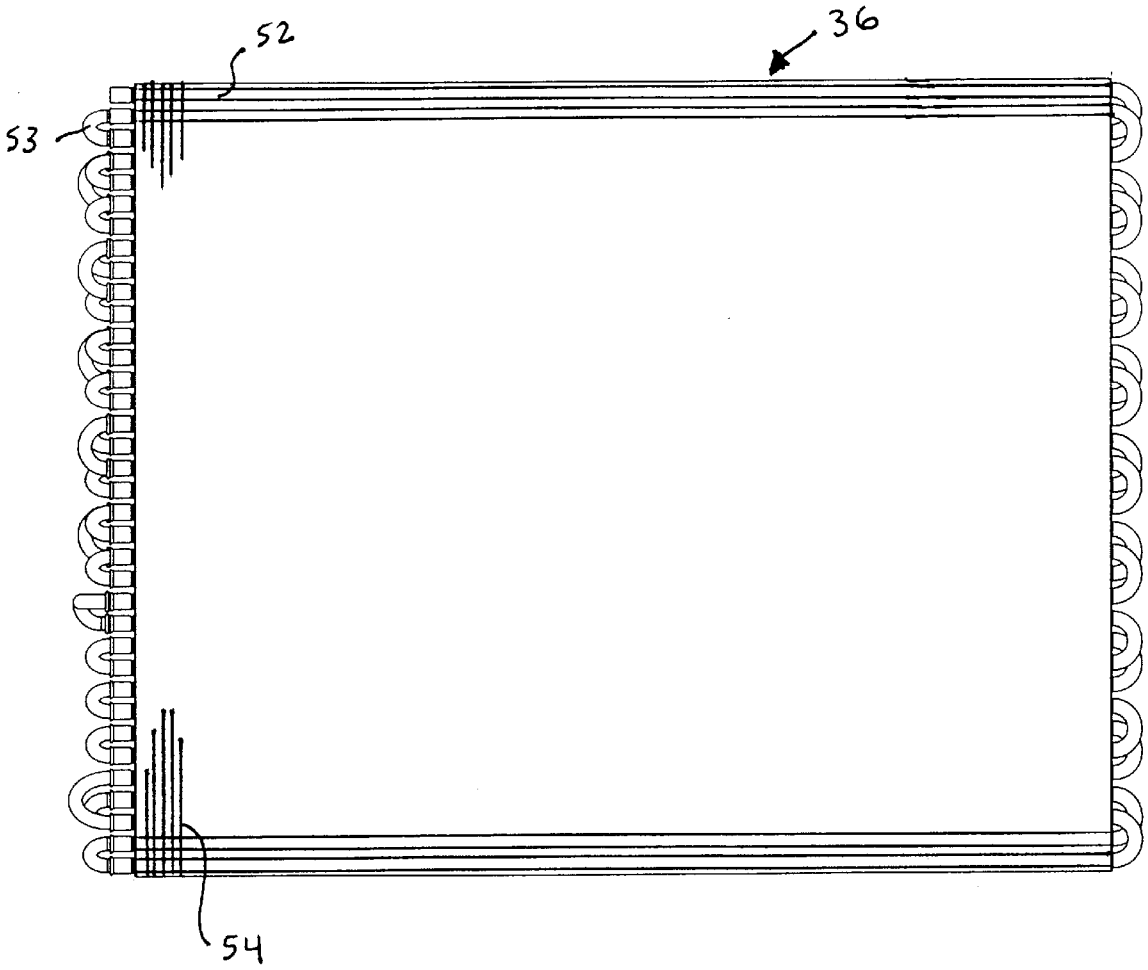
FIG. 5 is a rear elevational view of the condenser coil.

The condenser coil 36 includes a pair of symmetrical header plates 48, of which one is shown in detail in FIG. 4. The header plate 48 as shown in this embodiment has three vertical rows of openings 50 through which are arranged refrigerant carrying tubes 52 which extend across the width of the condenser coil 36 as seen in FIG. 5. The ends of the tubes are interconnected by return bends 53 so that a continuous single loop, of a serpentine shape, forms the condenser coil. If desired, a large number of closely spaced fins 54, typically formed of a thin aluminium material are penetrated by the tubes 52 to assist in heat transfer, as is well known.

Figure 6:
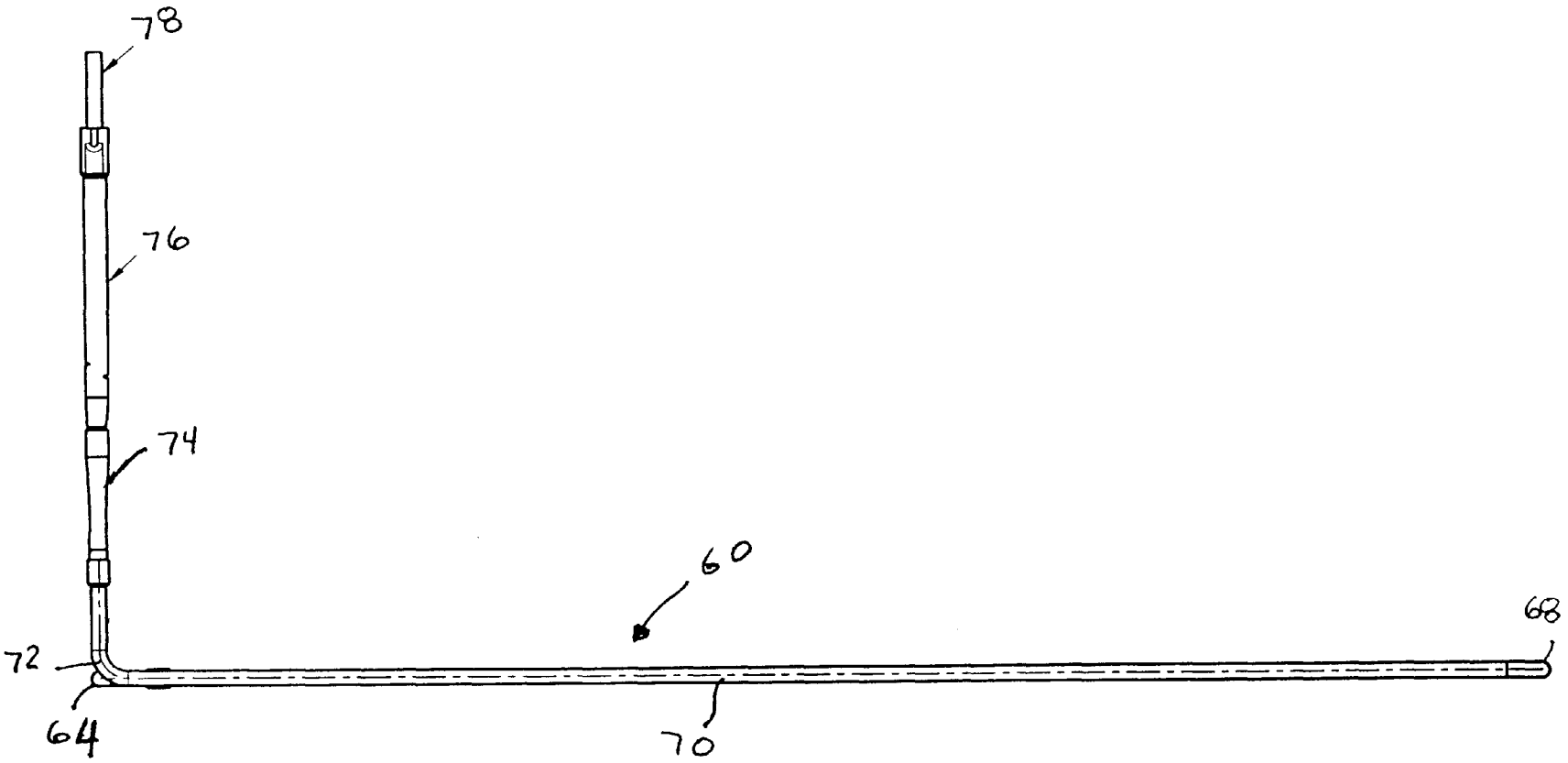
FIG. 6 is a side elevational view of a wet loop used in an embodiment of the present invention.
Figure 7:
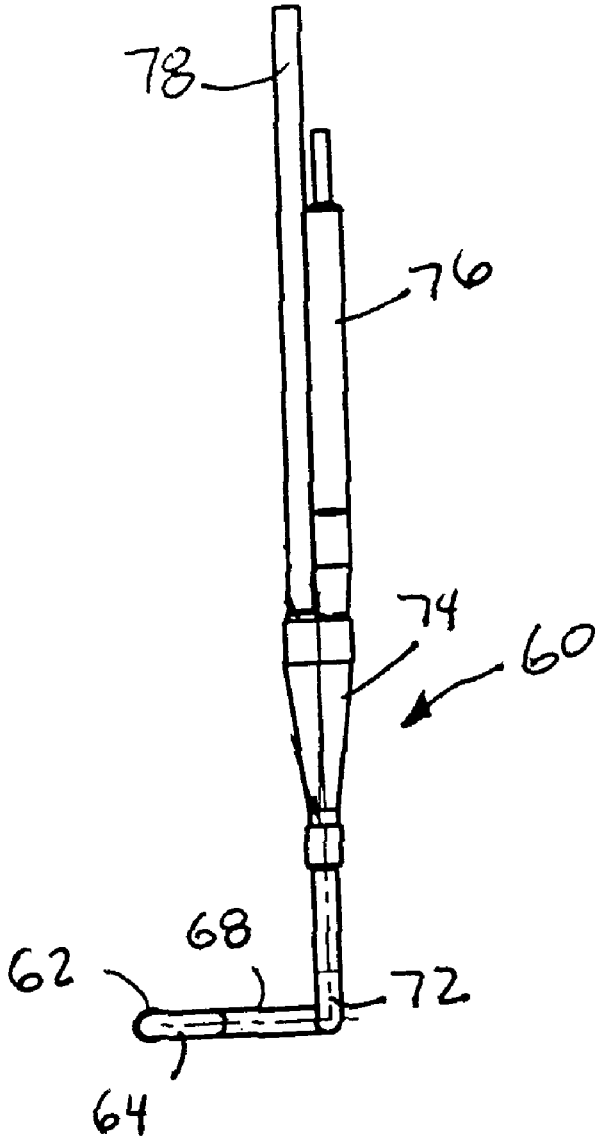
FIG. 7 is an end elevational view of the wet loop of FIG. 5.
Figure 8:
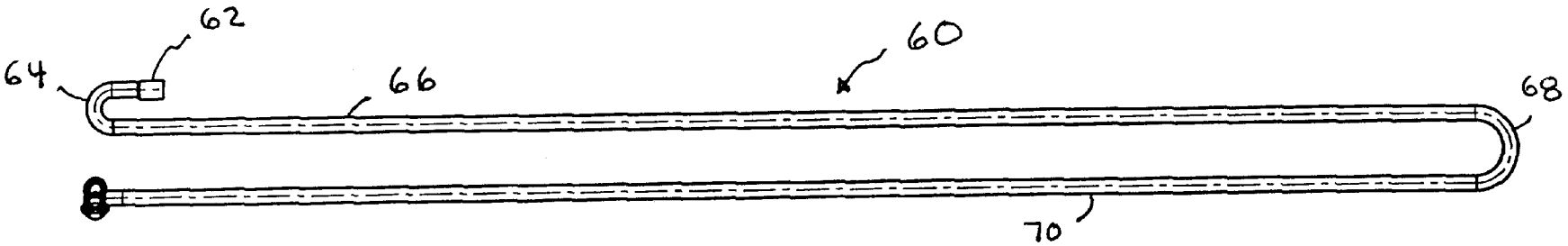
FIG. 8 is a plan view of the wet loop of FIG. 5.

The header plates 48 have two notches 56 formed in a bottom edge 58 of the plates which are sized to receive a wet loop tube. If a particular refrigeration device requires the use of a wet loop for the condenser, such a wet loop 60 as shown in FIGS. 6–8 can be connected to the refrigeration loop, such as by connecting a first end 62 of the wet loop 60 to the lowermost and leftmost opening 50 a in the header plate 48 in the orientation shown in FIG. 3. This lowermost opening comprises the discharge of the condenser coil 36 and when a wet loop is not utilized, a distributor extends from this opening connecting to the evaporator coil 38 via capillary tubes. The first end 62 of the wet loop 60 is connected to a 180° bend 64, which, in turn, is connected to a first elongated tube 66 which extends the entire width of the condenser coil 36.

A second 180° bend 68 connects the first elongated tube 66 to a second elongated tube 70 which also extends the entire width of the condenser coil 36. A 90 degree bend 72 secured to the second tube 70 and is directed upwardly. A flow divider 74 connects to the 90 degree bend 72 to divide the refrigerant flow into two separate paths, one path leading to a distributor tube and strainer assembly 76 and the other to a charge tube 78. Separate capillary tubes 80, 82 (FIG. 2) lead from the distributor tube and strainer assembly 76 and the charge tube 78, respectively, to the evaporator coil 38 where the condensed refrigerant is allowed to evaporate, and thereby absorb heat as it flows through the evaporator coil.

The elongated tubes 66, 70 are received in the area of the notches 56 after a part of the fins 54 (if present), in line with the notch nearest the first end 62 of the wet loop coil 60, is pushed over to form a channel in the lower surface of the condenser coil 36 to receive the first elongated tube 66. The second 180° bend 68 protrudes beyond the second header plate 48. The second elongated tube 70 is positioned outside of the fin area, so a pushing over of the fins is not required to accommodate the second elongated tube.

Figure 9:
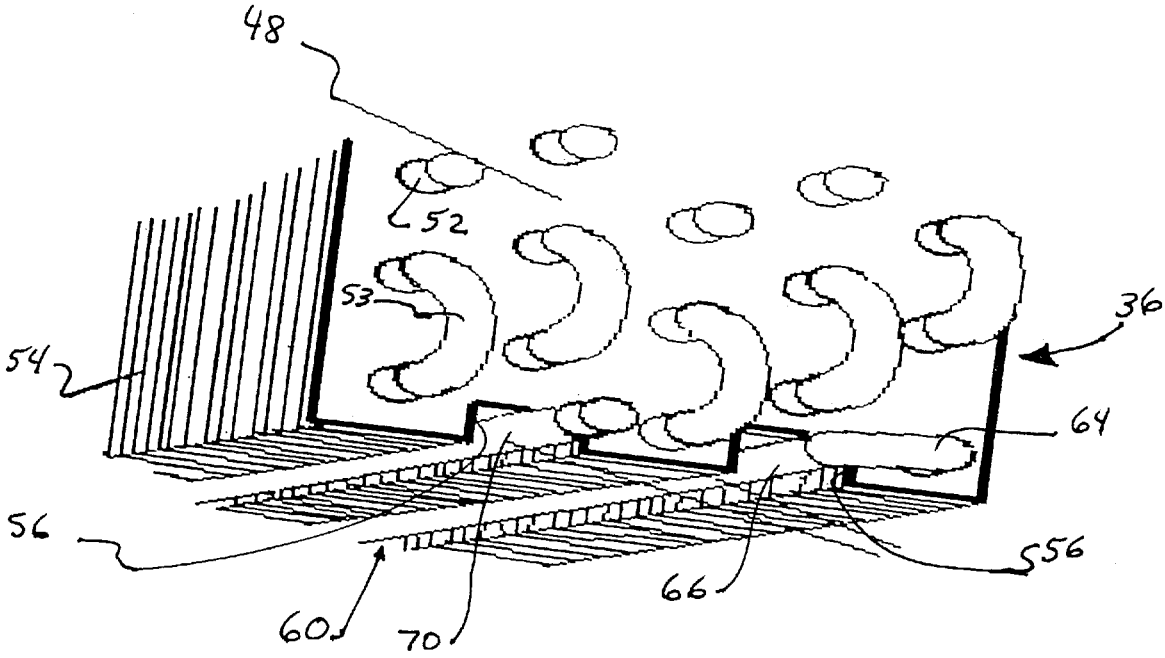
FIG. 9 is a partial perspective view of an alternate embodiment of the condenser coil with the wet loop in place.

It is seen that the notches 56 are aligned with the tubing of the condenser so that they are positioned on either side of a tube 52 a in the bottom row of the condenser coil 36 and are positioned below a tube 52 in the second to lowest row. In the embodiment illustrated in FIGS. 2–5, there are only three vertical rows of tubes 52, however in other arrangements, there could be more or fewer rows. When more rows are utilized, such as shown in the embodiment illustrated in FIG. 9 which has five vertical rows of tubes, a second channel must be formed by pushing over the fins 54 in line with the second notch 56*b* to accommodate the second elongated tube 70.

With any number of vertical rows of tubes, the fins 54 may be provided with slots, in line with the edges of the notches 56, to facilitate the pushing over of the fins in alignment with the notches. Further, the fins 54 alternatively may be formed with recessed areas aligning with the notches 56 so that the fins are not required to be pushed over in the area of the notches since no fin material would be present in that area, and the channels would be performed, even if no wet loop 60 is utilized.

Hence, with the condenser coil 36 embodying the principles of the present invention, a refrigeration device can be constructed without a wet loop 60, or with a wet loop, as desired, and no special accommodations are required to install the wet loop in a chassis of the refrigeration device, nor are any tooling changes required in the construction of either type of refrigeration device, nor are any additional parts required to complete the refrigeration circuit.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A room air conditioner comprising:

a compressor, a condenser, an evaporator, and tubing to connect the compressor to the condenser, the condenser to the evaporator and the evaporator to the compressor, said condenser coil including a plurality of tubes arranged in horizontal and vertical rows extending between vertically arranged header plates with return bends interconnecting the tubes to form a serpentine shaped circuit, said header plates being provided with two notches in a bottom edge thereof, said notches being positioned beside a tube in a lowermost of said horizontal rows of said tubes and each below a tube in a next lowermost of said horizontal rows, and a base pan for receiving said evaporator and said condenser coil, said base pan having a collecting area below said evaporator for receiving condensate from said evaporator, a depression that the condenser sits in to receive a full width and depth of said condenser, and a flow path extending between said collecting area and said depression to permit condensate from said collecting area to be received in said depression.

2. A room air conditioner according to claim 1, including a plurality of vertical fins forming a part of said condenser coil, positioned between said header plates and through which said tubes extend.

3. A room air conditioner according to claim 1, including a wet loop comprising a first elongated tube extending the entire width of said condenser coil and being positioned in a first of said notches of each header plate and a second elongated tube extending the entire width of said condenser coil and being positioned in a second of said notches of each header plate and being connected to said first elongated tube via a 180° bend.

4. A room air conditioner according to claim 3, wherein said wet loop is connected at a first end to a discharge of said condenser coil and at a second end to said distributor, and from distributor to capillary tubes to said evaporator.

5. A refrigeration device comprising:

a compressor, a condenser, an evaporator, and tubing to connect the compressor to the condenser, the condenser to the evaporator and the evaporator to the compressor, said condenser coil including a plurality of tubes arranged in horizontal and vertical rows extending between vertically arranged header plates with return bends interconnecting the tubes to form a serpentine shaped circuit, and said header plates being provided with at least one notch in a bottom edge thereof to accommodate a tube extending therebetween.

6. A refrigeration device according to claim 5, wherein said header plates are provided with two notches in a bottom edge thereof, each sized to accommodate a tube extending therebetween.

7. A refrigeration device according to claim 5, wherein said condenser coil includes at least one tube extending between said header plates adjacent to said notches.

8. A refrigeration device according to claim 5, including a plurality of vertical fins forming a part of said condenser coil, positioned between said header plates and through which said tubes extend.

9. A refrigeration device according to claim 5, including a wet loop comprising a first elongated tube extending the entire width of said condenser coil and being positioned in a first of said notches of each header plate and a second elongated tube extending the entire width of said condenser coil and being positioned in a second of said notches of each header plate and being connected to said first elongated tube via a 180° bend.

10. A refrigeration device according to claim 9, wherein said wet loop is connected at a first end to a discharge of said condenser coil and at a second end to said distributor, and from distributor to capillary tubes to said evaporator.

11. A refrigeration device according to claim 5, wherein said refrigeration device includes a base pan upon which said condenser coil is positioned, and said base pan includes a depression for receiving condensate from said evaporator, said depression accommodating an entire length and width of said condenser coil to sit in.

12. A refrigeration device comprising:

a compressor, a condenser, an evaporator, and tubing to connect the compressor to the condenser, the condenser to the evaporator and the evaporator to the compressor, said condenser coil including a plurality of tubes arranged in horizontal and vertical rows extending between vertically arranged header plates with return bends interconnecting the tubes to form a serpentine shaped circuit, and said header plates being provided with two notches in a bottom edge thereof, said notches being positioned beside a tube in a lowermost of said horizontal rows of said tubes and each below a tube in a next lowermost of said horizontal rows.

13. A refrigeration device according to claim 12, including a plurality of vertical fins forming a part of said condenser coil, positioned between said header plates and through which said tubes extend.

14. A refrigeration device according to claim 12, including a wet loop comprising a first elongated tube extending the entire width of said condenser coil and being positioned in a first of said notches of each header plate and a second elongated tube extending the entire width of said condenser coil and being positioned in a second of said notches of each header plate and being connected to said first elongated tube via a 180° bend.

15. A refrigeration device according to claim 14, wherein said wet loop is connected at a first end to a discharge of said condenser coil and at a second end to said distributor, and from distributor to capillary tubes to said evaporator.

16. A refrigeration device according to claim 12, wherein said refrigeration device includes a base pan upon which said condenser coil is positioned and said base pan includes a depression for receiving condensate from said evaporator, said depression accommodating an entire length and width of said condenser coil to sit in.

* * * * *